US005934530A

United States Patent [19]

Antczak et al.

[11] Patent Number: 5,934,530

[45] Date of Patent: Aug. 10, 1999

[54] GOLF ACCESSORY ORGANIZER

[76] Inventors: Gordon W. Antczak, 78950 Sonesta Way; Roy J. Goodwin, 79635 Marigold La., both of La Quinta, Calif. 92253

[21] Appl. No.: 08/927,576

[22] Filed: Sep. 8, 1997

Related U.S. Application Data

[63] Continuation-in-part of application No. 08/582,194, Jan. 2, 1996, abandoned.

[51] Int. Cl.[6] ..... A45F 5/00

[52] U.S. Cl. ..... 224/197; 224/245; 224/247; 224/678; 224/679; 224/918; 224/919; 224/933

[58] Field of Search ..... 224/933, 197, 224/918, 919, 660, 663, 665, 666, 676–680, 682, 684, 242, 245, 247, 248, 269, 184, 268; 206/315.1–315.3, 315.9; D3/221, 229, 257

[56] References Cited

U.S. PATENT DOCUMENTS

| | | | |
|---|---|---|---|
| 2,559,981 | 7/1951 | McBride | 224/184 |
| 2,665,830 | 1/1954 | Fowler | 224/919 |
| 2,926,403 | 3/1960 | Weissman | 224/247 |
| 4,625,862 | 12/1986 | Clayton | 206/315.3 |
| 4,840,332 | 6/1989 | Hoyt | 224/247 |
| 5,050,830 | 9/1991 | Hall | 224/918 |
| 5,176,253 | 1/1993 | Perrin et al. | 206/315.3 |
| 5,423,530 | 6/1995 | Gonzalez | 224/918 |
| 5,476,289 | 12/1995 | Hoyt et al. | 224/918 |

*Primary Examiner*—Gregory M. Vidovich
*Attorney, Agent, or Firm*—Lyon & Lyon LLP

[57] ABSTRACT

The golf accessory organizer allows a golfer to comfortably carry and easily access items such as tees, golf balls, golf-gloves, divot tools, ball markers, personal items or other small-type golfing accessories while playing a round of golf. Additionally, the device does not interfere with a golfer's swing or cause discomfort while the golfer is moving. The disclosed device is easy to manufacture, reliable, and lightweight as the main supporting member of the device is primarily manufactured from injection-molded plastic. Integral in this supporting member are tee holders and a ball marker holder and a pouch for holding golf balls may pivotally hang from the supporting member. Alternatively, a golf ball is retained in a pressure clip hinged to the supporting member. The supporting member may have an area covered with a hook or loop material for holding various small items such as a divot tool, golf glove, or sunglasses.

6 Claims, 3 Drawing Sheets

GOLF ACCESSORY ORGANIZER

RELATED APPLICATIONS

This application is a continuation-in-part of Antczak et al., U.S. Ser. No. 08/582,194, filed Jan. 2, 1996, now abandoned entitled "Golf Accessory Organizer" which is incorporated herein by reference in its entirety including any drawings.

FIELD OF INVENTION

The invention described herein relates generally to devices for holding and organizing accessories used in the game of golf. Specifically, this device concerns the carrying of tees, golf balls, golf-gloves, divot tools, ball markers, personal items and other small-type golfing accessories by an individual player while playing a round of golf.

BACKGROUND OF THE INVENTION

As is well known, golf is extremely popular in the United States and in other countries throughout the world. A golfer plays the game by striking a golf ball with golf clubs to move the ball toward a small hole. A single game of golf is called a round, which comprises either nine or eighteen holes. The purpose of the game is to move a golf ball from the starting position (tee off) to the end position (inside the hole) in as few swings, or strokes, as possible. Although it can vary greatly, the tee off position is typically several hundred yards from the hole. Surrounding and within a few yards of each hole is a special area called the green. The green comprises a thick, short grass that greens-keepers specially manicure to assure that the golf ball rolls easily and evenly. Most golf courses have strict rules on what golfers may and must do while playing on the green. For example, the rules do not allow golfers to place heavy items, such as golf bags on the green. Additionally, when a golf ball lands on the green, it may create a mark, or divot. Most course rules require golfers to repair their own ball marks.

To play golf properly, several pieces of equipment are mandatory, and several others are optional but increase the enjoyment of the game. Golfers must transport these items around the golf course as they continue through the nine or eighteen holes that comprise a golf course, which may total several thousand yards. Typically the golfer places the larger items, such as golf clubs, in a golf bag and carries or drives them around the golf course. However, several mandatory and optional pieces are quite small, and are difficult to find and use if placed in the golf bag. Two additional criteria make the golf bag an unsatisfactory choice to carry small, necessary items. First, if the golfer carries the bag around the course, it is proper golf etiquette not to bring the golf bag onto the green. However, golfers use several accessories while putting on the green, and if they need one, the golfer must walk to the bag laying at the edge of the green. This is not only time consuming, but affects a golfer's concentration. Second, if the golfer uses a golf cart to move about the course, the bag is kept in the cart, which is typically left on the cart road. The cart road may be many yards from the place where the golfer will take the next stroke. It is quite inconvenient and time consuming for the golfer to get to the golf ball, realize they need an accessory, and then have to retrieve that accessory from the golf bag in the cart many yards away.

Since placing small accessory items in the golf bag is so inconvenient, golfers often place these items in clothing pockets. This, too, is cumbersome and undesirable as the items are free to move within the pocket and can become hard to reach, fall out, poke the golfer, or even interfere with the golfer's club swing. A golfer will use some of these accessories regularly, but will use others only a few times in an entire round. For convenience and efficiency the golfer needs to keep these accessories readily accessible but out of the way, so will often place them in a pocket between uses. For example, a golfer often uses a golf-glove for the initial tee-off and other power-based swings. However, the golfer then removes the glove for comfort while moving to the next shot or while putting. The glove is typically placed in a clothing pocket where it may become uncomfortable or even fall out. The only alternatives are to place the glove in the cart or golf bag, but then the glove may not be readily accessible when golfer needs it.

Other necessary, but small items are golf tees. A tee is a device that holds a golf ball about an inch off the ground, allowing a golfer powerfully to hit the ball with a golf club without danger of the club hitting the turf. The tee is a plastic or wood cylindrical piece about three inches long with a rounded end that supports the ball and a sharp pointed end that penetrates the turf. Golfers use the tees at tee-off, and then usually place the tees in clothing pockets or the golf-bag until the next tee-off. Placing the tees in the bag or clothing is inconvenient as the small tees settle to the bottom of the compartment or pocket and are difficult to retrieve. Searching for tees in the bottom of a golf bag compartment or a pocket can also become painful if the golfer's fingers contact the tee point. Additionally, if placed in clothing pockets, the tees may irritate the golfer, reducing enjoyment of the game.

Carrying ball-markers to mark a ball position on the golf green is also customary. A ball marker is a small disk, about the size of a dime. It typically has a small spike in the center of one side to more securely attach to the golf green. Just as with the tees above, if the marker is placed in clothing pockets, the golfer will find it difficult to find a ball marker when needed, and the spike may cause discomfort.

Of course, the golfer also needs to carry golf balls since a typical golfer will lose one or more balls during a round. However, the golfer needs to carry only a couple extra balls since a larger supply can be kept in the golf bag or golf cart. Needing a second ball at tee-off time is common, especially for a novice golfer, if the first ball goes into water, lands outside the golf course bounds, or is otherwise unplayable. Rather than going back to the bag or cart, having an extra ball close by is convenient. Also, it is convenient for the golfer to have a holder for the ball currently-in-use while moving to the next hole, rather than carrying it by hand or placing it in the golf bag. Additionally, when golfers are playing with others on the green and their golf ball is in the way of another player's putt, a golfer will pick up the ball, place a ball marker to mark the spot, and hold the ball until it is that golfer's turn to putt. Again, the golfer could use an accessible and comfortable place to hold the ball.

Another device commonly carried around the golf course is the divot repair tool. When a golf ball lands on the green, it may leave a ball mark or indentation. This indentation, commonly called a divot, causes various problems for future golfers, such as erratic ball rolls. It is standard golf custom for golfers to repair their own divots as they play the course. Golfers perform repair with a small hand-held device with two sharp prongs, called a divot tool. The divot repair device, too, is small with sharp points so it has the inconvenience and interference problems associated with transporting both tees and ball marks. Because of these problems, the divot repair tool is often not easily accessible when a golfer discovers a divot, and so the golfer fails to repair it.

By keeping the tool more convenient to golfers, they are more likely to comply with the course rules and golf etiquette by repairing their own marks or even other persons' marks.

No device currently exists that can conveniently hold and allow easy access to golf balls, tees, a ball marker, golf glove, divot tool and other accessories. Two known devices attempt to ease the carrying of golf balls around a golf course. The first device is a small zippered pouch that holds two or three golf balls. This device has a small strap, apparently for attachment to a belt loop. Alternatively, the pouch may be placed in clothing pockets. This device is unsatisfactory for three reasons. First, if the device is placed on the golfer's waist, extracting just one golf ball is difficult. After opening the zipper, all the balls present in the device begin to roll out. Second, inserting a golf ball is difficult as when the zipper is opened the balls already inside the device begin to exit. Since the device is difficult to use while on the waist, it is likely that golfers will place the device in clothing pockets. Here the third shortcoming arises as the pouch, loaded with balls, can interfere with the free and comfortable movement of the golfer.

The second device is a ridged container worn on the belt and has a locking lid that secures two or three golf balls. This device suffers from four deficiencies. First, removing a ball from the container is difficult. Since the container is ridged, extracting a ball is not possible by simply pushing a ball upward, but instead, the entire container must be inverted. Inverting the container is not only uncomfortable and awkward, but distracts a golfer's concentration. Second, the golfer must unlock the latch to the container every time they insert or extract a ball, which is time consuming and distracting. Third, the ridged container allows the balls to shift within the container as the golfer moves. This shifting causes noise and vibration that are irritating to a golfer. Finally, the ridged device protrudes from the golfer's side and may interfere with the golfer's swing.

There is thus a need to provide golfers with a device that will solve the problems discussed herein. This invention provides an inexpensive and convenient device to carry golf balls, tees, a divot tool, a glove, and other small golfing or personal accessories around a golf course.

SUMMARY OF THE INVENTION

The present invention is directed toward an easy-to-use apparatus for organizing, holding and carrying golf accessories.

In a first separate aspect of the invention, the invention's supporting member conforms to the curvature of a golfer's waist. Additionally, the member may have a rubber or other backing that reduces slippage or other unwanted movement.

In a second separate aspect of the invention, the device may hold several individually secured golf tees.

In a third separate aspect of the invention, the device holds one or more golf balls in a collapsible pouch, with the top of the pouch automatically securing the balls in the pouch after the golfer has inserted the balls, and the top opening automatically to release a ball when the ball is manually moved upward.

In a fourth separate aspect of the invention, the device has sufficient space to allow the attachment of other devices and accessories using a hook and loop type fastener, such as Velcro.

In another separate aspect of the invention, the device does not interfere with the swing of a golfer.

In yet another separate aspect of the invention, the collapsible bags for holding the golf-balls are interchangeable to allow easy replacement or complete removal.

In another separate aspect of the invention, the supporting structure is manufactured from a single piece of injected molding to reduce manufacturing costs.

In yet another separate aspect of the invention, either a left or a right-handed golfer may wear the device and it is gender neutral.

In another separate aspect of the invention, the collapsible bag for the golf-balls may be made from various types of materials, including some that are washable. Additionally, the materials chosen can be of various colors and styles. A color and style may be chosen to coordinate with other clothing or golfing accessories. The material may also contain logos, trademarks, trade names, or other identifying marks.

In another separate aspect of the present invention, a supporting member is hinged to a pressure clip wherein the pressure clip contains a stabilizer. A golf ball may be placed in the pressure clip and is retained in the pressure clip by the stabilizer.

In yet another separate aspect of the present invention, a golf accessory supporting member is curved substantially equal to the curvature of a golfer's waist and further comprises a card pocket wherein the card pocket is sized to receive credit cards, business cards, or other such sized items.

DESCRIPTION OF THE PREFERRED EMBODIMENT

Figure 1:
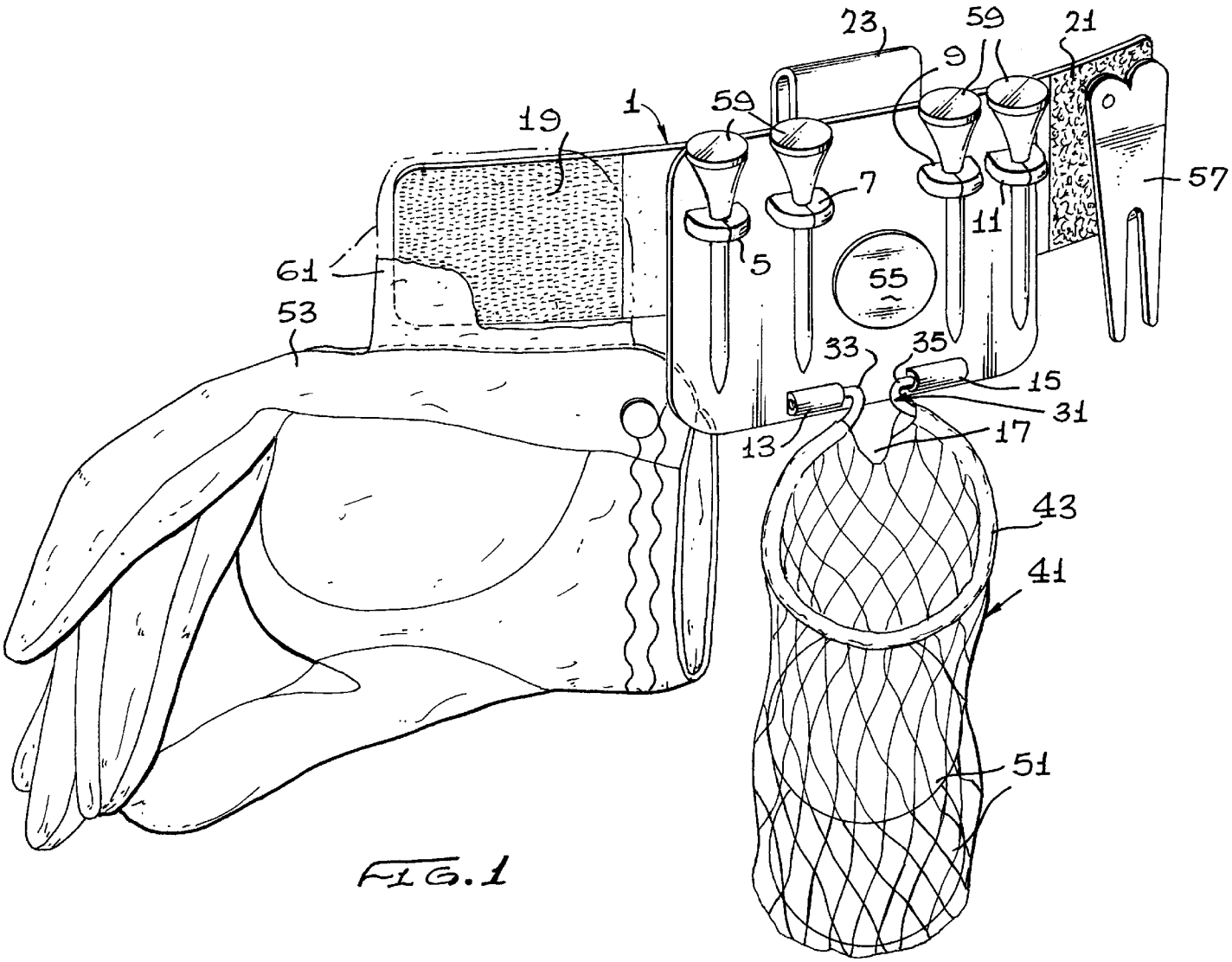
FIG. 1 is a perspective view of a preferred embodiment of the invention. We show the device with a golf glove, four tees, a ball marker, two golf balls, and a divot repair tool.

A preferred embodiment of the invention is shown in perspective in FIG. 1. This figure illustrates how the claimed device holds a golf glove, two golf balls, four tees, a ball marker and a divot repair tool. The supporting member 1 is curved substantially to conform to the curvature of a golfer's waist, and is designed to be worn at the waist of a golfer by having the clip 23 attach to a belt or the waistband of clothing. Typically the device is worn on the golfer's side. Due to its symmetrical design, the device may be worn on either the left or the right side of a golfer, thus enabling left or right-handed golfers comfortably to use the device. Also, the device hangs naturally from the waist of the golfer. As the golfer pivots, rotates, jumps, swings or walks, the device moves with the golfer. The device, however, stays out of the path of any swing or putt, so does not interfere with the golfer's strokes. Optionally, the backside of the device may have a backing or padding, possibly made from rubber, that helps in holding the device in place by reducing vertical and horizontal slippage.

All the accessories are easy to reach and comfortably organized for the golfer. The golf balls 51 are securely kept in the ball bag 41. Once a golfer inserts a ball 51, the weight of the ball pulls the ball bag 41 downward, which causes the bag spring 31 to be placed in tension against the top of the ball bag 41. Even abnormally rough activity will not allow the ball(s) 51 to exit the ball bag 41. However, removing a ball is done easily by manually "squeezing" the ball upward in the ball bag 41 until the bag spring 31 becomes nearly horizontal, opening the top of the ball bag 41 and allowing the golf ball 51 to exit. Using this device, golf balls may be securely and comfortably carried around a golf course, yet the golfer may easily remove one when needed.

The tee holders 5,7,9 and 11 securely hold the golf tees 59 in place. A golfer uses the tees by grabbing the rounded top of the tee only, avoiding any contact with the point. This also applies to the ball marker 55, which attaches securely to the front of the supporting member 1.

A golfer may attach a golf glove 53 and divot tool 57 to the supporting member 1 using hook and loop material. This allows the glove 53 and tool 57 to be securely held, but easily removed when needed. A golfer can attach other personal or golfing accessories to the supporting member 1 as needed. We will now discuss each part to the preferred embodiment in more detail.

Referring again to FIG. 1, the ball bag 41 is attached to the supporting member 1 using a bag spring 31. The bag spring 31 is inserted into a sleeve 43 at the top of the ball bag 41. The sleeve 43 goes around 7/8 of the circumference of the ball bag 41, with the bag spring 31 entering and exiting the sleeve 43 in the open area. In the at-rest position, as shown in FIG. 1, the bag spring 31 pivots from the ball bag eyelets 13 and to be positioned in nearly a vertical position. In this position, the weight on the bag spring 31 is sufficient to secure the golf ball or balls 51 in the ball bag 41. Additionally, the weight of the golf ball or balls 51 in the ball bag 41 helps in securing the bag spring 31 across the opening of the ball bag 41. Walking, swinging, or stooping is normally not sufficient to release the golf ball or balls 51. However, when the golfer manually begins moving a golf ball 51 up the ball bag 41 towards the bag spring 31, the bag spring 31 will become nearly horizontal, allowing the ball to easily emerge from the opening in the ball bag 41.

Figure 2:
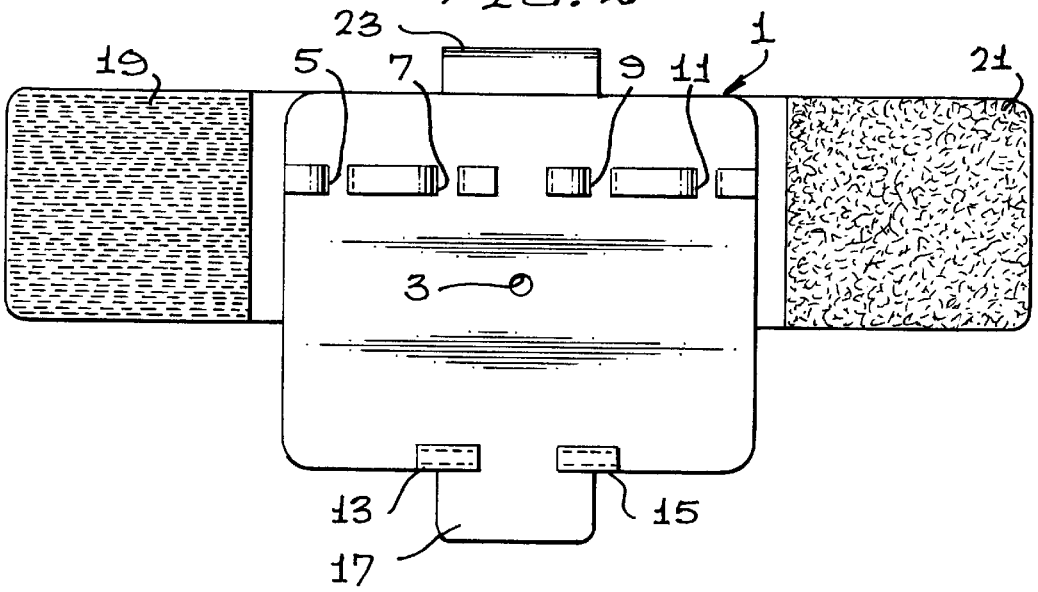
FIG. 2 is a frontal view of the supporting member.
Figure 4:
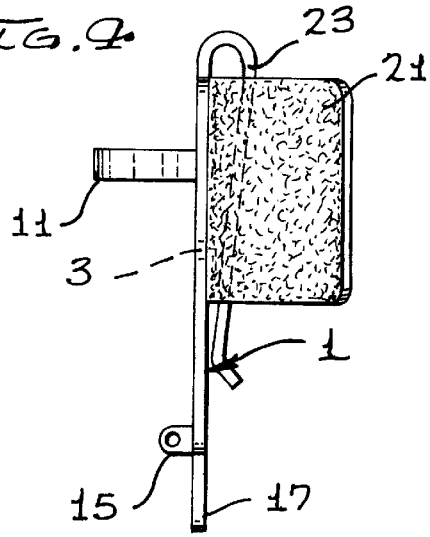
FIG. 4 is a side view of the supporting member.

FIG. 2 shows a front view of the supporting member 1. In the preferred embodiment the supporting member 1 is manufactured as a single piece of injection molded colored plastic. As such, it is inexpensive, light-weight, and durable. The supporting member is attached to a golfer by the clip 23. We show a side view with more detail of the clip in FIG. 4. It is clear to those skilled in the art that several alternate methods of attachment are readily available, such as spring-clip, belt-loop or other attachment method. In the preferred embodiment the clip 23 is part of the single piece of injection molded plastic. The clip 23 is manufactured with sufficient tension to attach securely to the belt or waist band on a golfer's clothing or to any surface capable of supporting the invention, such as the opening of a golf bag.

The supporting member 1 of the preferred embodiment has four tee holders 5,7,9 and 11. The tee holders 5,7,9 and 11 are again part of the single piece of injection molded plastic, with each tee holder sized to hold one tee securely. Each tee holder 5, 7, 9 and 11 has an opening in its generally annular shape that allows the plastic material of the tee holder 5, 7, 9 and 11 to expand and contract slightly during the insertion and extraction of a tee. The plastic is sufficiently malleable to allow this slight movement that securely holds the tee, yet allows for easy removal. Those skilled in the art will readily identify other attachment and securing methods such as the use of a rubber grommet, placing a rubber coating on the tee holder, or other method.

The supporting member 1 has a marker holder 3 to hold a golf ball marker. In the preferred embodiment this holder is simply a hole, which may be tapered, to adapt to the protruding spike on the back of the typical ball marker. Other methods of attachment could easily be substituted, such as magnetics, snaps, rubber inserts, hook and loop type fasteners or other methods. Also, the supporting member 1 could have more or fewer marker holders.

Optionally, the supporting member 1 may have additional surface area on which to store other accessories. On the preferred embodiment, this area is to both sides of the tee holders 5, 7, 9 and 11, and has a hook or loop material attached. The additional hook and loop space 19 and 21 is used to affix one side of a hook and loop type fastener. A hook and loop type fastener, such as Velcro, was selected as using it is easy, inexpensive, and golf gloves typically already use a hook and loop type fastener method of closing, so may be readily attached to the hook and loop type fastener on the supporting member 1. It should be clear to those skilled in the art that other attachment methods are readily available. On the preferred embodiment of the device, two hook and loop areas 19, 21 are available which may hold for example, a glove, divot tool, other golfing accessories, or personal items such as sun glasses or lip balm.

Again referring to FIG. 1, we show a preferred embodiment with a golf glove 53 attached to the hook and loop area 19. Since most golf gloves close using a hook and loop material, the golf glove will have two closing flaps 61, one of which will have a hook material and the other having a loop material. Thus, if the hook and loop area 19 has hook material, the glove 55 can attach with the loop flap, and in if the hook and loop area 19 has loop material, the glove can attach with the hook flap. In FIG. 1, the second hook and loop area 21 attaches a divot tool 57. If the hook and loop area 21 has hook material, a golfer attaches loop material to the. divot tool. If the hook and loop area 21 has loop material, hook material is attached to the divot tool. The golfer may then attach the divot tool to the supporting member 1.

FIG. 2 also shows the ball bag tab 17. The ball bag tab 17 is used to keep the ball bag 41 from interfering with the golfer's mobility. The ball bag tab 17 also acts as a motion stop for the bag spring 31, assuring the proper position for the ball bag when the bag spring 31 is in the near-vertical position. Without the ball bag tab 17, the bag spring 31 may continue rotating toward the golfer's leg, allowing the balls to hit and distract the golfer.

Figure 3:
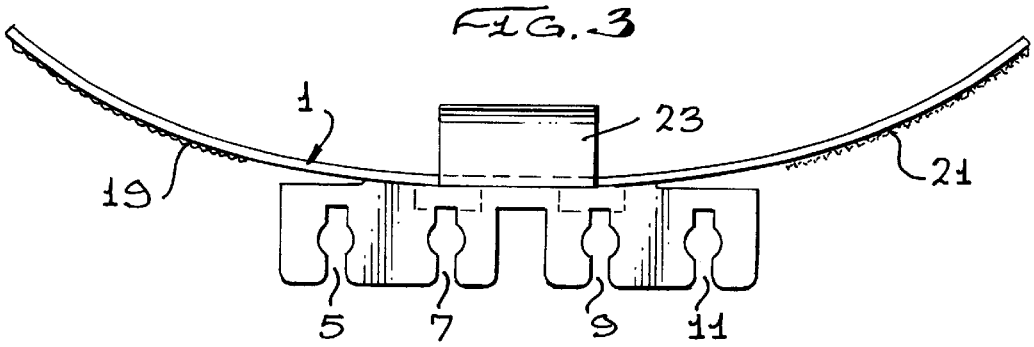
FIG. 3 is a top view of the supporting member.

FIG. 3 is a top view of the supporting member 1 and shows the inward curvature of the supporting member 1. The curvature is designed to adapt to the typical curvature of a golfer's waist. Experimentation defined this curvature and has been found to provide comfortable wearing for a wide range of sizes. Additionally, the shape and size of the supporting member 1 adapts to both men and women golfers. Also, it does not matter if the device is worn on the left or right side as it is symmetrically shaped.

Figure 5:
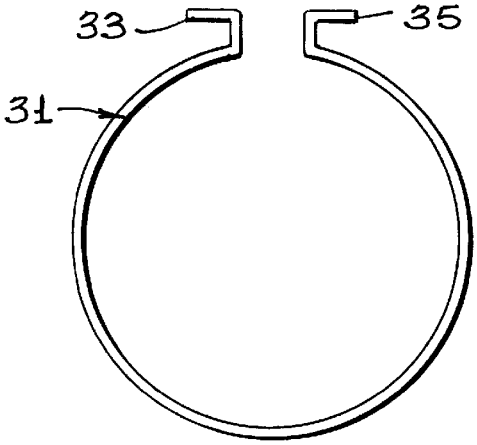
FIG. 5 is a top view of the bag spring.
Figure 6:
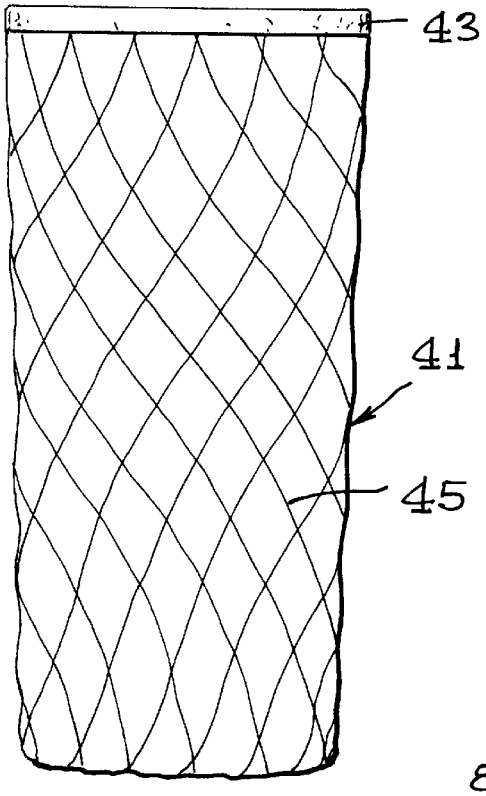
FIG. 6 is a front view of the ball bag.

FIG. 5 shows detail of the bag spring 31 and FIG. 6 shows detail of the ball bag 31. The bag spring is attached to the ball bag 31 using the ball bag sleeve 43. In the preferred embodiment the bag spring 31 is simply inserted through the ball bag sleeve 43 so the bag spring prongs 33 and 35 are visible. Other methods of attachment are readily ascertainable.

To attach the ball bag 31 to the supporting member 1, the bag spring 31 is threaded through the sleeve 43 until the bag spring prongs 33 and 35 are both accessible. A golfer then compresses the bag spring 31 so the bag spring prongs 33 and 35 are moved closer together. The bag spring prongs 33 and 35 are then placed in the ball bag eyelets 13 and 15 and the compression released, but an outward tension remains. The first bag spring prong 33 is then free to pivot in the first ball bag eyelet 13 and the second bag spring prong 35 is free to pivot in the second ball bag eyelet 15. Outward tension keeps the ball bag prongs 33 and 35 securely seated in the ball bag eyelets 13 and 15. Since the golfer may easily remove the ball bag 41, the ball bag 41 can be replaced as needed for repair or cosmetic reasons. In the preferred embodiment, the ball bag 41 consists of a washable material so the golfer may remove and replace it as it becomes soiled.

Although the preferred embodiment is typically worn on a golfer's waist, it is readily apparent to one skilled in the art that a golfer may mount other embodiments of the invention on other supports such as golf carts or golf bags. Also, other attachment methods could be used to attach the device to a golfer's body.

Figure 7:
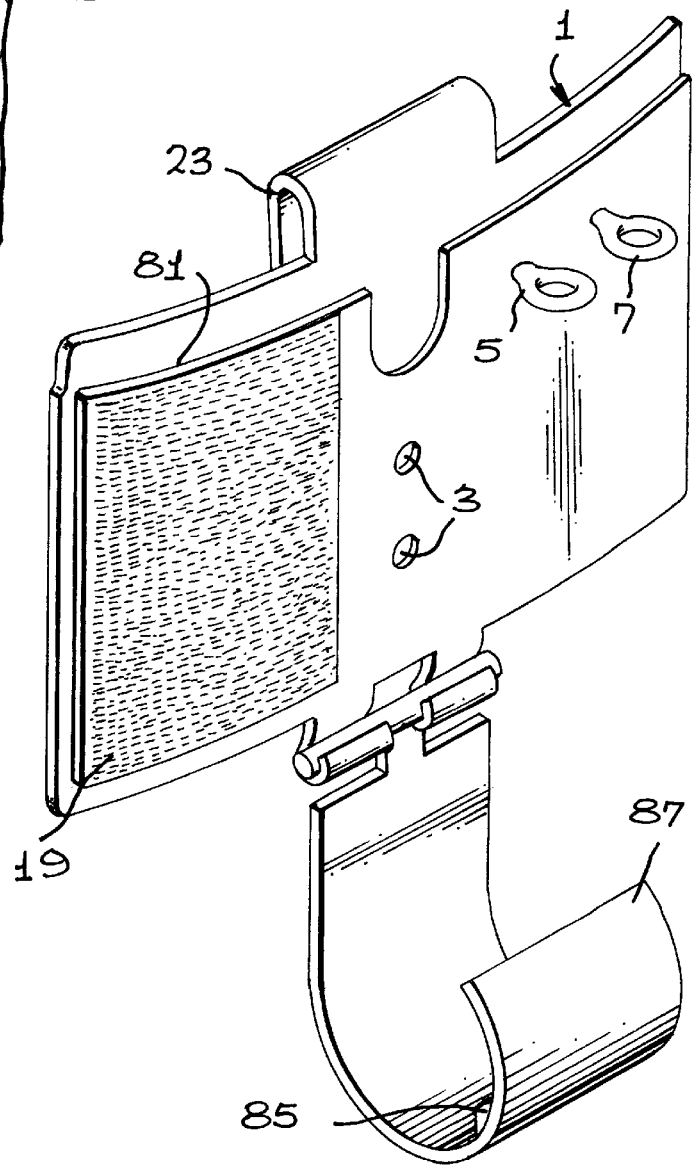
FIG. 7 is a perspective view of an alternative preferred embodiment.

An alternative embodiment of the present invention is shown in FIG. 7. In this embodiment, the supporting member 1 is curved to approximately equal to curve in a golfer's waist. This allows the supporting member 1 to snugly but yet freely ride against a golfer's waist. This supporting member 1 has a front face that contains two tee holders 5 and 7, two ball marker holders 3, and one hook and loop area 19. It is clear from the previous discussion that other combinations of tools, ball marker holders and tee holders are readily apparent to one skilled in the art. In this alternative embodiment, the supporting member 1 additionally comprises a card pocket 81. This card pocket 81 is integral to the supporting member 1 and is sized to hold items such as business cards, credit cards, plastic hotel keys and similarly sized objects. This card pocket 81 may be formed from two pieces or may be integral to a single molded supporting member. In the preferred embodiment, the card pocket 81 opening is sized and positioned to accept business cards and credit cards in a landscape mode. However, those skilled in the art will readily recognize that other configurations exist for the insertion and holding of such sized items.

This embodiment further has a pressure clip 87 hinged to the base of the face of the supporting member 1. The pressure clip 87 is rounded such that the pressure clip 87 extends about ¾ of the way around a golf ball when a golf ball is inserted into the pressure clip 87. Although this embodiment extends about ¾ around a golf ball, those skilled in the art will readily find that other distances greater than ½ and less than the full distance around the golf ball additionally work. The inside surface of the pressure clip 87 has a stabilizer 85 which assists in retaining a golf ball within the pressure clip 87. The pressure clip 87 is sized such that as the golf ball is inserted into the pressure clip, the pressure clip 87 exerts a force toward the golf ball as the golf ball passes over the stabilizer 85. This force causes the pressure clip 87 to expand slightly, allowing the golf ball to pass over the stabilzer 85. Once the golf ball has completely passed over the stabilizer 85, the pressure from the pressure clip 87 is reduced and the golf ball is retainably positioned inside the pressure clip 87. Although the pressure clip 87 may be exerting little or no force on the golf ball while the golf ball is within the pressure clip 87, if the golf ball moves toward a stabilizer 85, the stabilizer 85 acts as a barrier to keep the golf ball inside the pressure clip 87. In this preferred embodiment, the stabilizer 85 is a pair of protrusions only one of which is shown in FIG. 7 on the inside surface of the pressure clip.

Alternatively, the stabilizer 85 may be a recess in the pressure clip 87. In this embodiment, the pressure clip 87 is sized slightly smaller than before wherein inserting the golf ball results in a frictional pressure on the golf ball during insertion. However, when the golf ball enters the recess, the pressure is lessened. Since the golf ball is held in a position of lessened force, the golf ball will be retained until a golfer manually removes the golf ball.

While we have shown and described embodiments and applications of this invention, it would be apparent to those skilled in the art that many more modifications are possible without departing from the inventive concepts herein. The invention, therefore is not to be restricted except in the spirit of the appended claims.

What is claimed is:

1. A device to be worn on a golfer's waist for organizing and holding golf accessories, comprising:

a generally rectangularly shaped supporting member having a face and a back, the supporting member shaped with a curvature substantially equal to the curvature of a golfer's waist;

a clip on the back of the supporting member for securing the supporting member to the golfer's waist so that the supporting member is held in easy reach of the golfer but the supporting member does not interfere with the golfer swinging a golf club;

a J-shaped rounded pressure clip including an upwardly extending vertical section and a curved lower section, the curved lower section having an inside surface;

at least one stabilizer placed on the inside surface of the curved lower section of the pressure clip wherein a golf ball is retainably positionable in the pressure clip by the at least one stabilizer;

a hinge connecting the upwardly extending vertical section of the pressure clip to the supporting member; and an accessory area having means for holding a golf accessory and positioned on the face of the supporting member.

2. The device of claim 1 wherein the supporting member further comprises a card pocket integral with the supporting member.

3. The device of claim 1 wherein the accessory area has at least one tee holder configured for holding a golf tee.

4. The device of claim 1 wherein the accessory area has at least one ball marker holder configured for holding a ball marker.

5. The device of claim 1 wherein the accessory area has a hook and loop material configured for holding a golf glove.

6. The device of claim 1 wherein the rounded pressure clip retains one and only one golf ball.

* * * * *